United States Patent [19]

Goodwin

[11] 4,011,625

[45] Mar. 15, 1977

[54] LANCE TIP CONSTRUCTION

[75] Inventor: Robert J. Goodwin, Hendersonville, N.C.

[73] Assignee: C. H. Heist Corporation, Asheville, N.C.

[22] Filed: Sept. 8, 1975

[21] Appl. No.: 611,072

[52] U.S. Cl. ..... 15/104.1 R

[51] Int. Cl.[2] ..... B08B 9/02

[58] Field of Search ..... 15/104.09, 104.1 R, 15/104.11, 104.12, 104.16, 316, 317, 318; 134/8

[56] References Cited

UNITED STATES PATENTS

| | | | |
|---|---|---|---|
| 647,132 | 4/1900 | Dean | 15/104.09 |
| 1,193,361 | 8/1916 | Crepeau | 15/104.09 |
| 1,355,726 | 10/1920 | Zlatnik | 15/104.1 R |
| 2,313,042 | 3/1943 | Bay | 15/104.1 R |
| 2,411,209 | 11/1946 | Hall et al. | 15/104.09 |
| 3,226,258 | 12/1965 | Heist | 15/104.1 R X |
| 3,714,673 | 2/1973 | Brown | 15/104.1 R |

*Primary Examiner*—Edward L. Roberts
*Attorney, Agent, or Firm*—Joseph P. Gastel

[57] ABSTRACT

A tube cleaning lance tip construction including a body portion, a first bore extending longitudinally of said body portion for receiving high pressure liquid, a line of second bores in communication with said first bore and extending longitudinally of said body portion for conducting high pressure liquid to the outside of said body portion, said second bores terminating at planar surfaces extending transversely to the longitudinal axis of said body portion, serrated edges on the body portion, and a blade extending longitudinally of said body portion and being located generally diametrically opposite to said line of second bores so as to engage the inside of said tube with a force produced by the reaction from the liquid emanating from said second bores.

25 Claims, 15 Drawing Figures

LANCE TIP CONSTRUCTION

The present invention relates to an improved lance tip construction for use in cleaning deposits from the insides of tubes such as those used in heat exchangers, process equipment and pipe lines.

By way of background, in many applications the tubes in heat exchangers, process equipment and pipe lines build up foreign deposits during normal use. These deposits may comprise compounds which include carbon, silicon and calcium as constituents and/or organic compounds, depending on the nature of the fluids flowing through the tubes. In the past, the removal of such deposits was difficult, relatively inefficient and costly. Various methods which were utilized included high pressure water cleaning, drilling and sand blasting. The high pressure water cleaning heretofore used could not remove the more tenacious deposits. The drilling and sand blasting in addition to being slow and extremely costly processes, many times injured the inside surfaces of the tubes. It is with overcoming the foregoing deficiencies of the prior art that the present invention is concerned.

It is accordingly one important object of the present invention to provide an improved lance tip construction for cleaning deposits from the insides of tubes by means of a combination of high water pressure and a cutting and/or scraping action. A related object is to provide an improved lance tip which removes deposits in an extremely efficient manner. Other objects and attendant advantages will be more fully perceived hereafter. The present invention relates to an improved tube cleaning lance tip construction comprising a body portion having a longitudinal axis and an outer surface, first bore means in said body portion for receiving high pressure liquid, second bore means in communication with said first bore means and extending through said body portion to said outer surface, said second bore means extending transversely to said longitudinal axis so as to cause liquid to impinge on the inside of said tube, and blade means extending longitudinally of said body portion so as to engage the inside of said tube. The various aspects of the present invention will be more fully understood when the following portions of the specification are read in conjunction with the accompanying drawings wherein:

FIG. 1*a* is a fragmentary side elevational view partially broken away showing the improved lance tip of the present invention mounted on a lance within a tube which is being cleaned;

FIG. 1*b* is a fragmentary side elevational view which is a continuation of FIG. 1*a* and shows the hydromechanical system which advances the lance axially and rotates it while supplying high pressure liquid thereto;

Figure 14:
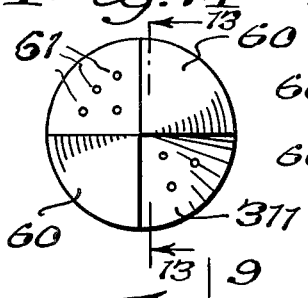
Figure 13:
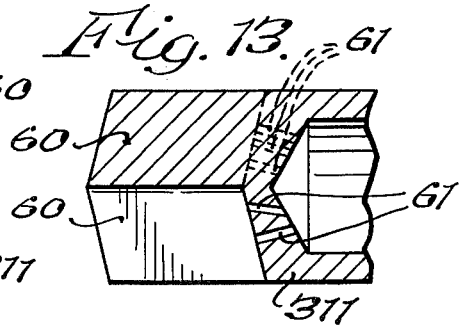

FIG. 13 is a fragmentary cross sectional view taken substantially along line 13—13 of FIG. 14 and showing an alternate form of construction having forwardly projecting bores and blades on the front of the lance tip; and FIG. 14 is an end elevational view taken from the left of FIG. 13. Summarizing in advance, the improved lance tip 10 of the present invention is intended to be mounted on a lance 24 which is rotated and moved axially through a tube 18 which is to be cleaned.

The improved lance tip 10 of the present invention includes a body portion 11 having a bore 12 therein which passes through threaded connector portion 13 formed integrally with body portion 11. Connector portion 13 may be of any suitable type. High pressure liquid which is supplied to bore 12 is forced through jet producing bores 14 which are in communication with bore 12 and terminate at surfaces 15 formed on the outer surface of the lance tip. While surfaces 15 are shown as being planar, they may also be curved, if desired. The surfaces as shown at 15 are inclined at an angle of 60° to the horizontal and bores 14, being perpendicular thereto, are inclined at an angle of 30° to the horizontal. Bores 14 may be oriented at any other angle which will provide optimum cleaning and satisfactory operability. The exact angle may be tailored in accordance with the nature of the incrustation being treated. If desired, bores 14 may extend in a plurality of rows with each row including bores at an angle different from the bores in other rows so as to provide a different cleaning effect from each row of bores. Surfaces 15 may be formed at any satisfactory angle by any suitable machining operation.

From the drawings it can be seen that a pair of serrated edges 16 are formed when surfaces 15 intersect with opposite planar side wall surfaces 17 of body portion 11. As lance tip 10 rotates in tube 18, which may be located in a tube bundle or which may be any other tube which is being cleaned, the serrations 16' of edges 16 may engage any incrustations or projections of foreign matter 35 within tube 18 and aid in removing them if the high pressure water has not already done so. Edges 16 are blades in the sense that they effect a severing action on foreign matter which they engage, if such foreign matter obstructs their path. In this respect, the outer tips of serrations 16' may each attack a small portion of the deposit and aid in its removal to provide an overall efficient removal action by the lance tip. Collar 25 tends to prevent edges 16 from engaging the inside surface of the tube itself.

In addition to edges 16, a cleaning blade 19 having a sharp edge 20 is formed on body portion 11. Edge 20 is substantially diametrically opposite to the substantially straight line of bores 14. Therefore, the reaction force from the high pressure water emanating from bores 14 causes cutting edge 20 to ride against the inside of tube 18. Considering that all of the reactive force is concentrated along the knife-edge 20, there will be a high unit force at the knife edge which will provide an extremely efficient finishing action to the inside of the tube which has been substantially entirely cleaned by the high pressure water emanating from bores 14 combined with any cutting action produced by edges 16. It is to be noted that bores 14 point forwardly so that there will be a series of cleaning jets impinging on the inside of the tube in advance of the leading edge 21 of knife 19. However, if desired the bores may point rearwardly for specific cleaning applications where it is desirable to have the blades engage the inside of the tube before the high pressure water does. It is also to be noted that leading edge 21 of knife 19 tapers rearwardly from lance tip nose portion 22, and further that there is an uniform taper 23, of which portion 21 is a part, extending rearwardly from nose portion 22. Tapered portion 23 guides lance tip 10 over incrustations in the tube and tapered knife portion 21 cuts or shaves projecting incrustations as lance tip 10 advances. Blade 19 is also tapered on the rearward portion 22'. The tapered portions on each end of blade 19 and nose portion 22 also ease the entry or retraction of the rotating tip 11 into the ends of a tube. In this respect, it is preferred to start rotation of the lance and high pressure water flow before the tip enters the tube and to continue it after it leaves the opposite end of the tube and also continue it as the top is withdrawn so as to effectively clean both ends of the tube.

Bores 14 are inclined to the horizontal so as to cause the length of jet between the outer end of each bore 14 and the inside of the tube to be longer than if the bores 14 extended perpendicularly to the longitudinal axis of body portion 11, and also to be longer than if the bores 14 were drilled into a surface which was not cut in the manner shown in FIGS. 2–5. This provides two advantages: (1) In general, deposits are more readily removed from a surface such as that in a tube as shown in 18 if the jet stream attacks the deposit at some angle less than 90° but greater than 0°. This permits the jet stream to pry or spall the deposit from the surface rather than crush or disintegrate it as usually occurs if the jet stream contacts the deposit at 90°. (2) The utilization of the energy contained in the jet stream at an acute angle provides a longer "stand-off" distance which has been found to be more effective in cleaning the inside of a tube such as 18. In other words, if the outer end of bore 14 terminated immediately proximate the inside of the tube, the high pressure liquid would not be as effective in cleaning as if it were placed, within certain limits, a greater distance away from the inside of the tube. In addition to providing a longer stand-off distance while maintaining a relatively large outer diameter of the lance tip, the faces 15, being perpendicular to the direction of bores 14, permit the latter to be drilled more easily. If desired, the bores 14 may be drilled into the body portion 11 without providing planar surfaces 15. In this case, the stand-off distance can be determined by the diameter of body portion 11, and in a modification of this type, serrated edges 16 would be absent. A lance tip without serrated edges 16 may be used for certain applications.

In use, lance tip 10 is screwed into the end of lance 24, which is a hollow metal tube slightly greater in length than the tube to be cleaned. A common length is 20 to 40 feet. As shown in the drawings, the end of lance 24 abuts flange 25 at the junction of body portion 11 and nipple 13 to provide a liquid-tight seal. Lance 24 is engaged by a suitable rotating mechanism 26 driven by motor 27. This causes lance 24 and lance tip 10 to be rotated at a desired rate of speed. An advancing mechanism 28, which is driven by motor 29, also engages lance 24 for advancing it axially through tube 18 while it is being rotated by unit 26. The mechanism for rotating and advancing lance 24 may be of any desired type. The end of lance 24 remote from lance tip 10 mounts a swivel unit 30 which is connected to hose 31. Swivel 30 prevents leakage between lance 24 and hose 31 and also permits lance 24 to rotate without accompanying rotation of hose 31. Hose 31 is connected to pump 32 driven by motor 33. Pump 32 receives water from conduit 34 and supplies it at high pressure to conduit 31.

Lance tip 10 can be caused to rotate at any desired rate of speed. A range which has been used effectively is between 10 and 500 rpm. The rotation speed can be adjusted for optimum cutting action depending on the physical characteristics of the incrustation 35 within the tube being cleaned. In other words, certain incrustations will require a longer residence time of the high pressure water and blade 20 and serrated blades 16 (is used). To this end the speed of rotation of the lance tip can be increased while the speed of axial advance is maintained constant. Other substances will require a lesser residence time and to this end the speed of rotation can be decreased or, alternatively, the speed of rotation may be held constant and the axial advance increased. In addition, the length of time that any unit portion of tube 18 is exposed to high pressure water and the blades depends on the rate of axial advance of lance 24. This can be adjusted to any desired rate of speed. In practice the lance has been driven between 5 and 100 feet per minute. Thus from the foregoing it is to be noted that the rate of deposit removal is a function of the interrelated variables of tip rotational speed and the rate of its axial advance. Both are independently controlled to provide optimum cleaning efficiency.

As noted briefly above, the primary cleaning of incrustations 35 within tube 18 is effected by high pressure liquid emanating from bores 14. This pressure is at a minimum of approximately 3,000 to 5,000 pounds per square inch and in view of the fact that the substantially straight line of bores 14 produce an elongated cutting jet which extends substantially the length of lance tip 10, it has the effect of a sweeping hydraulic knife rotating through tube 18 as it is advanced axially. In certain instances the incrustations might be extremely hard and might not be removed by the high pressure water alone. In this event, any such incrustations that are built up sufficiently so that they are contacted by the serrated edges 16 and knife edge 20, will be severed by the latter. Edges 16 and 20 are cooled and lubricated to some extent by the high pressure water which surrounds the lance tip.

Figures 1A, 1B, 2, 3, 4, 5:
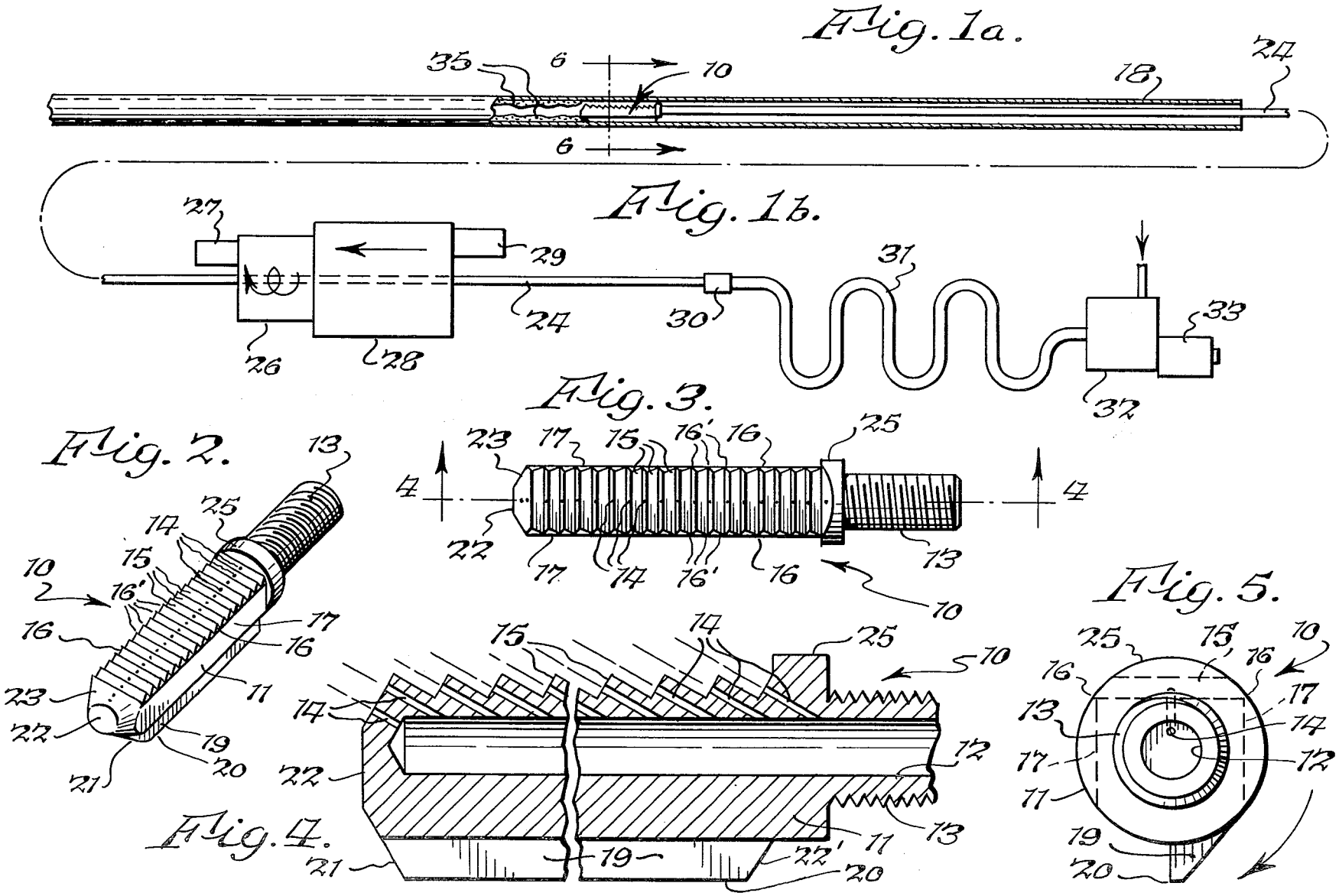
FIG. 2 is a perspective view of one form of the improved nozzle of the present invention.
FIG. 3 is a plan view of the nozzle of FIG. 2.
FIG. 4 is a fragmentary cross sectional view taken along line 4—4 of FIG. 3.
FIG. 5 is an end elevational view taken from the right of FIG. 3.

After lance 24 has been advanced the entire length of the tube, motor 29 is reversed to cause lance 24 and lance tip 10 to be withdrawn, that is, it is then moved from left to right within tube 18 in FIG. 1*a*. However, the direction of rotation of lance 24 will remain the same as when it was advanced from right to left. The flow of high pressure liquid will be continued to lance 24 while lance tip 10 is being withdrawn from tube 18 and this will produce additional cleaning and/or a finishing action on the inside of the tube by a combined water jet impingement from bores 14 and a wiping action by blade 19.

Figure 6:
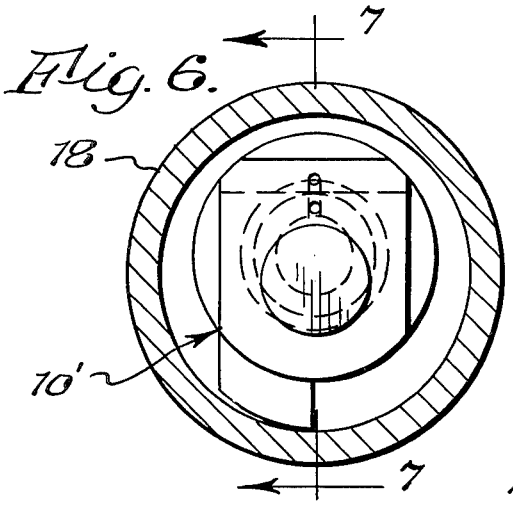
FIG. 6 is an end elevational view of a modified form of lance tip taken from the left of FIG. 7 and showing the lance tip positioned within a tube which is being cleaned.
Figure 7:
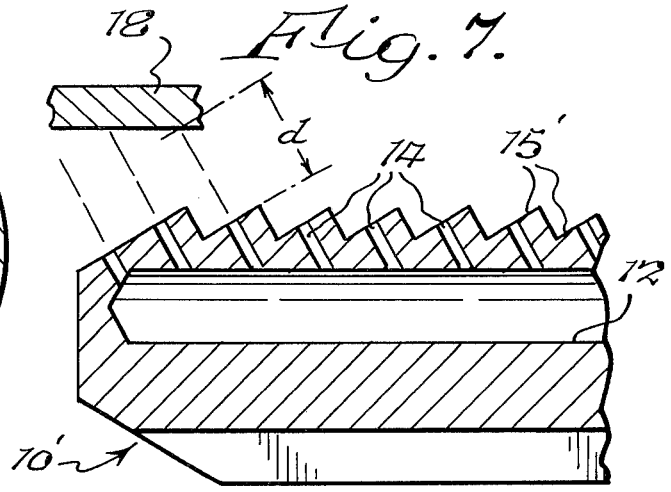
FIG. 7 is a fragmentary cross sectional view taken substantially along line 7—7 of FIG. 6 and showing particularly the angle of the orifices through which high pressure liquid is ejected.

A modified lance tip construction 10′ is shown in FIGS. 6 and 7. This tip may be identical in all respects to that shown in FIGS. 1–5, except that bores 14′ are oriented at an angle of 60° to the horizontal. In addition, faces 15′ are oriented at an angle of 30° to the horizontal. Actually the angle of the water conducting bores, such as 14 and 14′, may be adjusted within a relatively wide range of limits as required for different types of incrustations, as noted above. However, the angle should be such as to provide the desired stand-off distance *d* between the face 15′ and the inside of tube 18 and/or optimum angle of attack on the incrustation to be removed.

In use, dimensionwise, a lance tip 7/10 of an inch maximum diameter has been used successfully in a tube having an internal diameter of 9/10 of an inch, with a pressure at the lance tip of about 9,300 psi. Actually the pump 32 supplies about 10,000 psi, but 700 psi is usually lost in the hydraulic circuit due to friction. It is contemplated that for effective operation the clean tube diameter can be only slightly larger than the maximum diameter of the lance tip. However, departures in dimensioning may be made as required for effective operation. In this respect, the characteristics of various incrustations vary so widely, that many times it is a matter of experimenting with lance tip constructions of various sizes having various angles of bores 14 until the optimum combination is found. Actually as long as the jets clean the inside of the tube, there is no upper limit of tube size relative to lance tip diameter.

Figure 10:
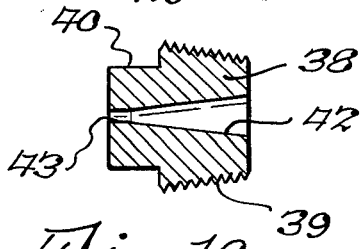
FIG. 10 is a cross sectional view of the lance tip inserts which are used in the embodiment of FIGS. 8 and 9.
Figure 8:
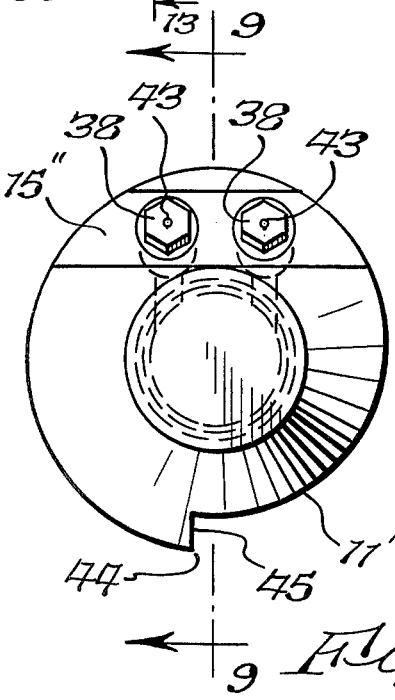
FIG. 8 is an end elevational view of a still further modified form of lance tip taken from the left of FIG. 9.
Figure 9:
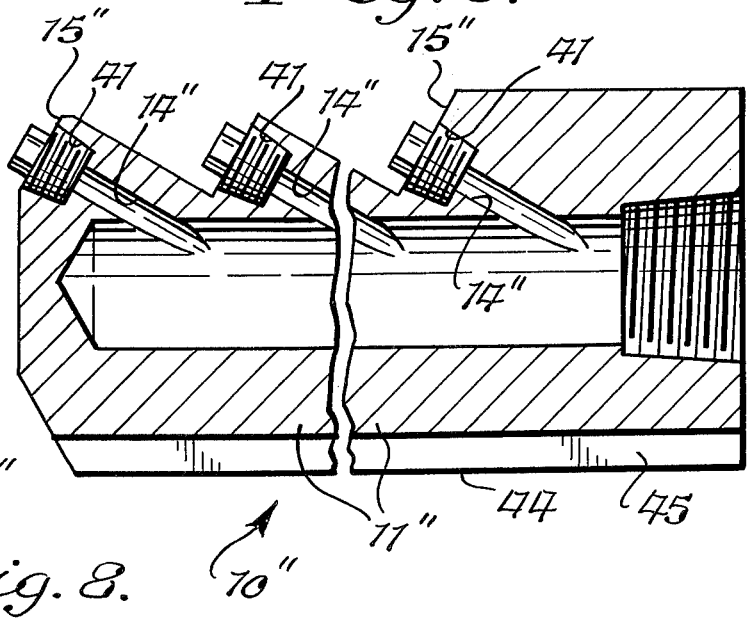
FIG. 9 is a fragmentary cross sectional view taken substantially along line 9—9 of FIG. 8.

In FIGS. 8–10 a still further modified form of lance tip construction is shown. This embodiment includes a body portion 11″ having faces 15″ formed thereon. Each face mounts one or more lance tip insert plugs 38 having a threaded portion 39 and a wrench-receiving portion 40. Threads 39 are received within tapped portions 41 and seat tightly therein. Bores 14″ in body portion 11″ are in communication with bores 42 within plugs 38 and bores 42 in turn are in communication with bores 43 through which the high pressure liquid emanates. It can be seen that the jets emanating from lance tip 11′ come out in two parallel lines, thereby providing a double hydraulic action for impinging on the inside of the tube. It is further to be noted that the edge 44 of cutting blade 45 is located on a line between the two lines of bores but lies substantially diametrically opposite to the portion of the lance tip from which the jets emanate. The lance tip 10″ of FIGS. 8–10 is approximately three inches in diameter and is intended to be used with furnace tubes or other tubes which have an internal diameter in excess of about 3 ½ inches.

By way of example and without limitation, the lance tips have the following dimensions. The tip of FIGS. 2–5 is approximately one inch long from its tip to collar 25. The highest point of collar 25 above the edges of the planar surfaces 15 is approximately 3/64 of an inch. Bores 14 are 1/64 inch in diameter and bore 12 is ⅛ inch in diameter. The lance tip of FIGS. 6 and 7 is approximately 2 ¼ inches long from its nose to the front edges of the collar which corresponds to collar 25 of FIGS. 2–5. The longitudinal bore is 13/64 in diameter and bores 14′ are 1/64 inch in diameter. The lance tip of FIGS. 8–10 is approximately 3 ½ inches long from its tip to the beginning of the collar corresponding to collar 25. The longitudinal bore is approximately 29/32 of an inch in diameter and bores 14″ are 3/16 of an inch in diameter. Bores 43 are approximately 1/32 inches in diameter and bore 42 tapers outwardly at an included angle of 15°.

Figure 11:
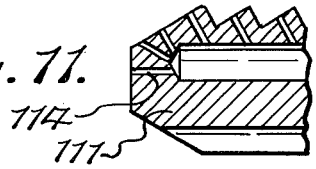
FIG. 11 is a fragmentary cross sectional view showing an optional form of tip construction which can be used in conjunction with any of the lance tips.

In FIG. 11 an alternate embodiment of the present invention is shown which can be used in conjunction with all of the previous embodiments of the present invention. In the embodiment of FIG. 11 the body portion 111 includes a bore 114 for directing high pressure water forwardly of the lance tip to aid in clearing any deposits which might lie directly forwardly of the lance tip. While only one bore 114 is shown, it will be appreciated that any number can be used and that they can be disposed in any desired orientation to achieve a cleaning action directly forwardly of the lance tip.

Figure 12:
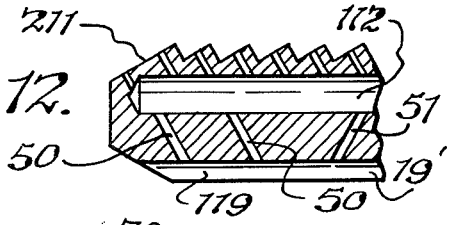
FIG. 12 is a fragmentary cross sectional view showing an embodiment which includes bores for directing jets against the knife to clean it.

In FIG. 12 a still further embodiment of the present invention is disclosed which can be applied to all of the foregoing embodiments of the present invention. In the embodiment of FIG. 12 a lance tip 211 is shown which may be identical in all respects to all of the lance tips shown in FIGS. 1–10. In the embodiment of FIG. 12 a plurality of additional bores, such as 50 and 51, are shown in communication with central bore 112 which receives high pressure water from the lance. Bores 50 and 51 are aimed directly at the face 19′ of knife 119 to clear any foreign matter therefrom which may be sufficiently tenacious to adhere thereto during operation. In other words, bores 50 and 51 function strictly as a source of high pressure water for cleaning the knife. It will be appreciated that the total reactive force on the inside of the tube resulting from flow through bores 50 and 51 should not exceed the total reactive force produced by bores such as 14. It is to be especially noted that bores such as 50 and 51 may take the form of actual bores as shown in FIG. 12 or they may take the form of plugs such as 40 shown in FIG. 10. The latter type of plugs would be used in conjunction with the embodiment shown in FIGS. 8 and 9. In addition, the plugs may be solid so that the embodiment shown in FIGS. 8 and 9 may be used with open plugs to provide a blade cleaning action or with closed plugs which would prevent high pressure water from being projected against the blade.

In FIGS. 13 and 14 a still further embodiment of the present invention is disclosed. In this embodiment the body portion 311 includes blades 60 formed on the front of the lance tip and also includes bores 61 pointing forwardly. The combination of liquid emanating from the bores and the blades provide an action for the purpose of cleaning tubes which are either entirely plugged or substantially entirely plugged. The subject matter of FIGS. 13 and 14 can be incorporated in any of embodiments of FIGS. 1–10. Alternatively, if desired, the subject matter of FIGS. 13 and 14 can be used by itself as a lance tip for clearing plugged conduits.

In all the embodiments, the bores, such as 14, through which the high pressure liquid ultimately emanates are preferably as small as possible consistent with obtaining the required volume of liquid flow, thereby causing the liquid velocity within the lance to be as slow as possible to thereby cut down on liquid friction losses within the lance and preserve the high pressure for the liquid being projected against the inside of the tube being cleaned.

The materials which can be cut from the inside of tubes include any materials which accumulate therein including, without limitation, inorganic compounds formed of carbon, silicon and calcium, and/or deposits of organic compounds.

It can thus be seen that the improved cutting lance tip construction of the present invention is manifestly capable of achieving the above enumerated objects and while preferred embodiments have been disclosed, it will be understood that the present invention is not limited thereto but may be otherwise embodied within the scope of the following claims.

What is claimed is:

1. A tube cleaning lance tip construction for insertion into a tube comprising a body portion having a longitudinal axis and an outer surface, first bore means in said body portion for receiving high pressure liquid, second bore means in communication with said first bore means and extending through said body portion to said outer surface, said second bore means extending transversely to said longitudinal axis so as to cause said high pressure liquid to impinge on the inside of said tube, said second bore means also effectively being located only on one side of said body portion, and blade means on said outer surface extending longitudinally of said body portion to engage the inside of said tube, said blade means being effectively located on a side of said body portion which is opposite to said one side whereby said blade means will be forced into engagement with the inside of said tube as a result of the reactive force of high pressure liquid emanating from said second bore means.

2. A tube cleaning lance tip construction as set forth in claim 1 wherein said second bore means are oriented at an acute angle to said longitudinal axis.

3. A tube cleaning lance tip construction as set forth in claim 1 wherein said second bore means comprises a plurality of bores extending longitudinally of said body portion.

4. A tube cleaning lance tip construction bores set forth in claim 3 wherein said plurality of boxes extend substantially in a line longitudinally of said longitudinal axis.

5. A tube cleaning lance tip construction as set forth in claim 3 wherein said outer surface includes a plurality of distinct surfaces and wherein said bores extend through said distinct surfaces.

6. A tube cleaning lance tip construction as set forth in claim 5 wherein said surfaces are planar.

7. A tube cleaning lance tip construction as set forth in claim 5 wherein said distinct surfaces extend transversely to said longitudinal axis.

8. A tube cleaning lance tip construction as set forth in claim 7 wherein said bores are substantially parallel to each other.

9. A tube cleaning lance tip construction as set forth in claim 7 wherein said body portion includes portions which are adjacent to said distinct surfaces and which extend transversely to said distinct surfaces, and second blade means formed by said distinct surfaces intersecting with said adjacent portions of said body portion to provide a serrated edge.

10. A tube cleaning lance tip construction as set forth in claim 9 wherein said blade means is located generally circumferentially opposite to said second bore means.

11. A tube cleaning lance tip construction as set forth in claim 1 wherein said blade means comprises a blade having an edge extending lengthwise of said longitudinal axis.

12. A tube cleaning lance tip construction as set forth in claim 11 wherein said edge of said blade is substantially parallel to said longitudinal axis.

13. A tube cleaning lance tip construction as set forth in claim 11 wherein said blade is located generally circumferentially opposite to said second bore means.

14. A tube cleaning lance tip construction as set forth in claim 11 wherein said body portion includes a front end, and an inclined lead-in portion extending forwardly from said blade toward said front end.

15. A tube cleaning lance tip construction as set forth in claim 11 wherein said blade includes an inclined leading portion tapering toward said front end.

16. A tube cleaning lance tip construction as set forth in claim 15 wherein said blade includes an inclined trailing portion tapering away from said front end.

17. A tube cleaning lance tip construction for insertion into a tube comprising a body portion, bore means effectively located on one side of said body portion for causing liquid to be ejected with a net lateral force component on the inside of said tube to bias said body portion toward said tube, and blade means on said body portion for engaging the inside of said tube as a result of the reaction force of said liquid emanating from said bore means.

18. A tube cleaning lance tip construction as set forth in claim 17 including second blade means positioned between said bore means and said blade means.

19. A tube cleaning lance tip construction as set forth in claim 18 wherein said second blade means includes serrated edges.

20. A tube cleaning lance tip construction as set forth in claim 18 wherein said second blade means are located on opposite sides of said bore means.

21. A tube cleaning lance tip construction for insertion into a tube comprising a body portion, bore means effectively located on one side of said body portion for causing liquid to be ejected with a net lateral force component to bias said body portion toward said tube, and blade means extending longitudinally of said body portion and extending toward the inside of said tube for removing deposits therefrom.

22. A tube cleaning lance tip construction as set forth in claim 21 wherein said bore means include bores directed at said blade means for cleaning said blade means.

23. A tube cleaning lance tip construction as set forth in claim 21 wherein said blade means comprise serrations on said body portion.

24. A tube cleaning lance tip construction as set forth in claim 23 wherein said blade means comprise an additional blade having a continuous edge.

25. A tube cleaning lance tip construction as set forth in claim 21 wherein said blade means comprise a plurality of cutting members spaced axially on said body portion.

* * * * *

UNITED STATES PATENT OFFICE

CERTIFICATE OF CORRECTION

PATENT NO. : 4,011,625

DATED : March 15, 1977

INVENTOR(S) : Robert J. Goodwin

It is certified that error appears in the above-identified patent and that said Letters Patent are hereby corrected as shown below:

Column 2, line 22, begin a new paragraph with the word "Summarizing".

Column 3, line 32, change "top" to --tip--;
line 57, the word "stand-off" should appear in quotes;
lines 62 and 63, the word "stand-off" should appear in quotes.

Column 6, line 23, change "all" (second occurrence) to --any--.

Column 7 (claim 4), line 42, change "bores" to --as--;
line 43, change "boxes" to --bores--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*